US007389610B1

(12) United States Patent
McMakin et al.

(10) Patent No.: US 7,389,610 B1
(45) Date of Patent: Jun. 24, 2008

(54) DOOR SYSTEM

(75) Inventors: Russell L. McMakin, Lyman, SC (US); Kenneth A. Newton, Lyman, SC (US)

(73) Assignee: Boiler Tube Company of America, Lyman, SC (US)

( * ) Notice: Subject to any disclaimer, the term of this patent is extended or adjusted under 35 U.S.C. 154(b) by 380 days.

(21) Appl. No.: 10/909,240

(22) Filed: Jul. 30, 2004

Related U.S. Application Data

(60) Provisional application No. 60/491,370, filed on Jul. 31, 2003.

(51) Int. Cl.
*E05D 15/58* (2006.01)

(52) U.S. Cl. ..... 49/254; 110/173 R; 122/498; 432/250

(58) Field of Classification Search ..... 49/254; 220/314; 110/173 R; 122/6.5, 498; 432/250
See application file for complete search history.

(56) References Cited

U.S. PATENT DOCUMENTS 2,105,248 A * 1/1938 Johnson ..... 68/139
4,574,973 A 3/1986 Lewis et al.
4,669,628 A * 6/1987 Hatta ..... 220/211
4,685,586 A 8/1987 Lewis et al.
5,158,043 A 10/1992 Emsbo
5,487,563 A * 1/1996 Hiramatsu ..... 280/806
5,803,021 A * 9/1998 Rourke et al. ..... 122/498
6,412,221 B1 7/2002 Emsbo

* cited by examiner

*Primary Examiner*—Blair M. Johnson
(74) *Attorney, Agent, or Firm*—Leatherwood Walker Todd & Mann, P.C.; Thomas W. Epting

(57) ABSTRACT

A door system used in a doorway of a pressurizable compartment of a high temperature structure, having a screw for compressing the door and a thrust collar providing clearance between the thrust collar and a bearing member during decompression of the door such that in the event the pressurizable compartment is pressurized, the pressure is relieved through the doorway while the door remains in contact with the doorway. The screw includes a shoulder, and the thrust collar is carried on the screw between the shoulder and the bearing member. The collar is configured to bear against the bearing member and the shoulder upon compression of the door. A debris guard covers and protects the screw during advancement and retraction of the screw, and a door frame is provided having weld slots for facilitating welding of the door frame to the high temperature structure.

6 Claims, 10 Drawing Sheets

DOOR SYSTEM

This application claims benefit of U.S. Provisional application Ser. No. 60/491,370, filed Jul. 31, 2003, the entirety of the disclosure of which is incorporated herein by reference thereto.

BACKGROUND OF THE INVENTION

This invention relates generally to a door system, and in particular, to a door system suitable for use for high temperature applications such as boilers, flues, bag houses, precipitators, scrubbers, and the like.

To gain access to compartments inside of boilers or other high temperature-type structures for inspection, repair, maintenance, such structures usually includes one or more access openings with doors. One such door is disclosed in U.S. Pat. No. 5,158,043, issued to Jon Emsbo, entitled "High Temperature Application Door Installation." This door is configured for a gas-tight sealing engagement with an access opening in a high temperature environment, and includes an outer door panel, and an inner door assembly with an inner door plate having one or more transversely extending yokes mounted thereon.

Each yoke is pivotally attached at one end from one side of the door frame by hinges, and cooperates with a latch pin locking arrangement at the opposite end, which is used to maintain the door in a closed position. A handle is provided which, upon being turned, forces the inner door plate and yoke apart, and this reaction between the yoke and its associated mounting hinges and latch pin causes the inner door plate, which includes a peripherally-mounted sealing gasket, to be pressed firmly into engagement with the door frame, thereby sealing the door opening.

U.S. Pat. Nos. 4,574,973 and 4,685,586, both issued to Lewis, et al., also disclose doors for high temperature applications.

SUMMARY OF THE INVENTION

Generally, the present invention includes a door system having an improved yoke assembly and also a door frame design which facilitates attachment of the door system, and in particular the welding of the door frame, to a structure.

The yoke assembly of the present invention includes a turning screw having two threaded portions. The first threaded portion is threadingly engaged with a nut block and contacts the front side of the inner door plate to cause the door, which is normally in a concave configuration, to flatten upon advancement of the turning screw, such that the inner door seals tightly around its periphery of the door frame. The second threaded portion receives a nut for fastening a handle to the turning screw.

In sealing the door, the four corners of the door first contact the door frame. As the turning screw advances, however, the peripheral edges of the door also seal against the door frame due to the flattening of the concave, or dome shaped, configuration of the inner door against the door frame. This flattening feature is also due to an X-shaped bracing arrangement which is attached, preferably by welding, to the backside of the inner door panel. This bracing arrangement serves to more equally distribute the force supplied by the turning screw about the periphery of the door plate.

The turning screw of the present invention also includes two projections, or, shoulders. The first shoulder acts as a bearing surface against which a thrust collar bears. The thrust collar is carried between the first shoulder and the backside of a plate of the yoke assembly, and allows for turning of the turning screw, even when the inner door is under pressure due to the pressure in the compartment, or such as when the door has been fully shut and the normally domed-shape of the inner door flattened. When the door is in this configuration, the dome shape of the door exerts an outward force on the turning screw, and simultaneously, if the door is sealing a pressurized environment within the structure, the pressurized environment would exert an outward force on the inner door. The second shoulder is located at the intersection of the second threaded portion of the screw.

The turning screw also includes two flats which are received within a slot of the turning handle, and the slot prevents the turning handle from movement relative to the turning screw. The edges of the two flats are threaded, and a steel jam nut is threadingly carried thereon.

A nut block is preferably bolted to the yoke assembly with two or more bolts, rather than being welded. This allows for easy maintenance and disassembly of the nut block, if necessary. The upper surface of the nut block includes a slot through which the stem of a T-shaped dust cover slides, as the turning screw is advanced towards and away from the inner door plate.

The thrust washer provides for accurate spacing of the door and of the turning screw. This spacing allows, once the door has been closed, for a slight amount of play in the turning handle when it is desired to back out the turning screw in order to open the door. Through use of this play, or "window of opportunity," the turning screw can be moved slightly and stopped. If the chamber to which the door is attached is under pressure, pressure from inside the compartment will immediately begin to be released from inside of the compartment, and such pressurized gas or fluid will immediately escape about the periphery of the door, while the four corners of the door still remain in contact with the door frame. This is a safety consideration in that should an attempt be made to open the door fully when the compartment sealed by the door is under pressure, by slightly turning the handle, it will be readily apparent that the door should not be opened, and the handle can then be turned in the direction to advance the turning screw inwardly, to again reseal the inner door. The resealing of the inner door is accomplished by flattening out the concave or dome-shaped configuration of the inner door.

Further, in certain situations, there may be fly ash or other material physically pressing against the door, even if the compartment is not in a pressurized state. If the door is then attempted to be opened, the turning handle can be rotated slightly through the "window of opportunity," and it will likely become apparent that fly ash or other materials are pressing against the door, prior to the door being fully opened. Again, the turning handle could be turned in the opposite direction to advance the turning screw inwardly to reseal the door, prior to the door being fully opened.

In conjunction with the foregoing features of the door system of the present invention, a release pin is provided which prevents the door from inadvertently becoming opened. Once the door is sealed, it is very difficult to remove the pin, since it is under pressure due to its flattened concave state. However, as the turning handle is rotated in a direction to retract the turning screw, there will come a point where pressure is relieved in the yoke assembly as the door returns to its normally-concave configuration. At this point, the release pin can be removed. However, as noted above, when using the window of opportunity, the turning handle can be rotated a slight distance, which slightly opens the door, while still maintaining the four corners of the door in physical contact with the door frame. At this point, the release pin is still under lateral pressure, and is not removable. However, as noted above, also at this point, it can be readily determined whether the compartment is under pressure, or if material, such as fly ash is pressing against the door. In such an event, the door should again be resealed and the release pin maintained in place.

Accordingly, the present invention includes a method of rotating the turning handle slightly to cause the door seal against the door frame to be broken, while still retaining the door generally in place and subject to reclosure. By breaking the seal, the operator is alerted if the chamber or compartment being sealed by the door is pressurized, or if there is undue pressure being applied against the door by fly ash material.

In one preferred embodiment, there is a clearance of approximately twenty-four to twenty-five thousandths between the inner door and the thrust collar. The thrust collar is not threaded, and should not wander or creep. The thrust collar serves to accurately set and maintain the clearance, thereby allowing for the window of opportunity.

The door system of the present invention includes components of a modular construction, and in particular, the nut block and handle, which allows for such components to be reassembled and parts replaced as necessary. In certain other doors in the prior art, for example, certain components may be welded, and such did not allow for easy maintenance and disassembly. Also in such doors, a dust cover was provided which was fixedly attached to the yoke and did not travel with the turning screw as the turning screw moved. This meant that the dust cover only protected part of the turning screw, as when the turning screw was fully advanced in a door sealing configuration. It is desirable to cover the turning screw with the dust cover in order to prevent fly ash and other corrosive materials and debris from settling on the threads of the turning screw. When such debris is deposited and accumulates on the threads of the turning screw, this can cause the threads of the turning screw to gall within the nut block, thereby potentially causing premature failure of the turning screw.

The door system of the present invention includes a movable dust cover, including a T-shaped flat plate, preferably made of stainless steel. The plate includes a stem, which passes between two bolts used to fix the nut block to the yoke assembly. The nut block defines a recess, or, track in which the stem slides as the turning screw advances inwardly and retracts outwardly. Thus, the full length of the turning screw is generally covered by the stem of the dust cover as the turning screw moves inwardly and outwardly.

The door system of the present invention also includes a door frame having slots defined in the face of the periphery thereof. These slots allow for the door frame to be welded to the structure from the front side of the door frame, thereby allowing for easy access. With certain doors in the prior art, the door frame required to be welded about the inner periphery, and also the outer periphery (in order to prevent the outer periphery from drawing in upon the inner being welded). In certain situations, it may be particularly difficult to weld the outer periphery since such outer periphery could be difficult to reach, particularly, if such door frame was against an outcropping or other projection of the structure, since clearance around the outer periphery would be minimized.

Thus, with the slots defined in the face of the door frame, the inner periphery of the door frame can be readily welded, as well as the face or outer portions of the door frame.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
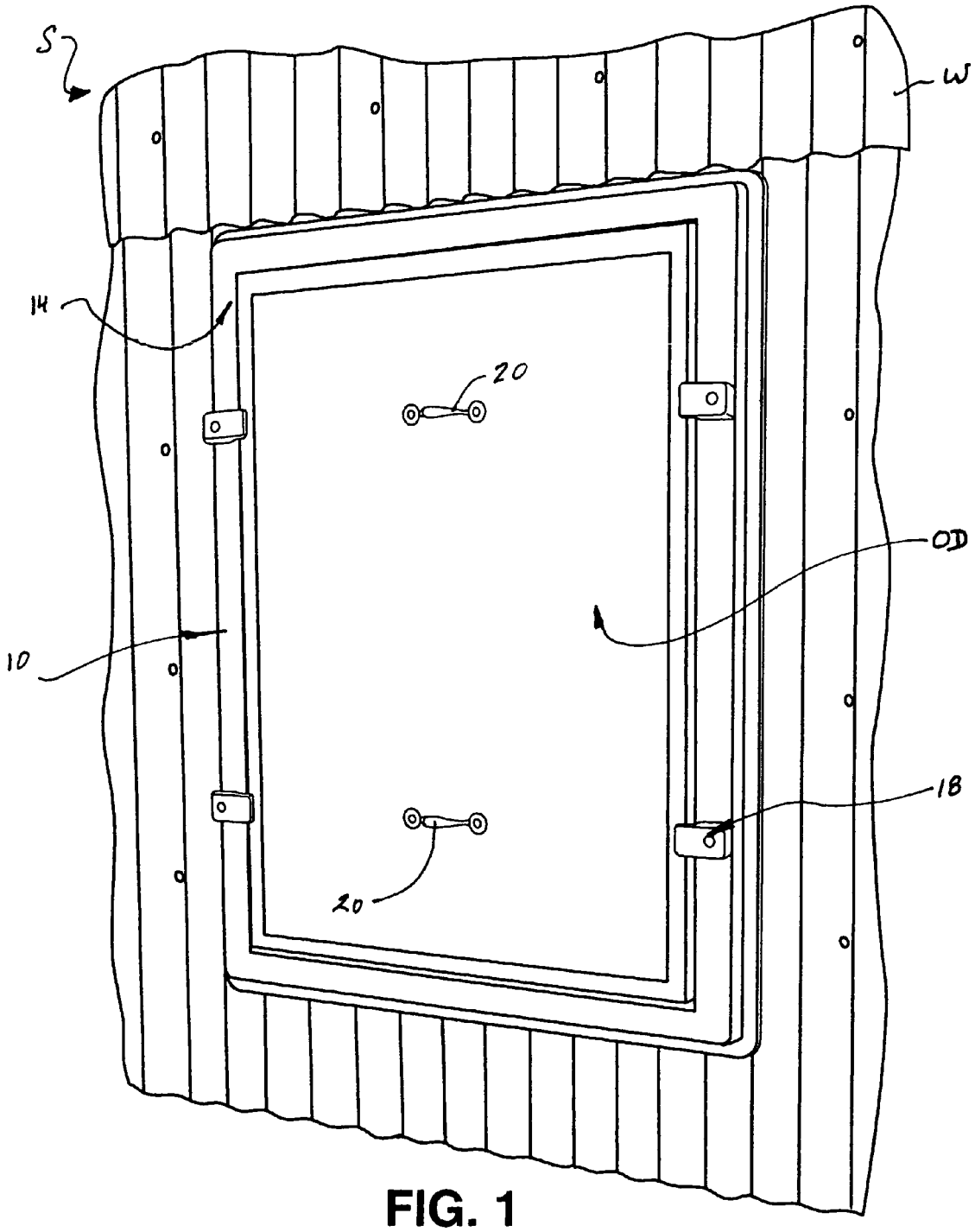
FIG. 1 is a perspective view of a door system constructed in accordance with the present invention, with an outer door in place.

The accompanying drawings and the description which follows set forth this invention in its preferred embodiment. However, it is contemplated that persons generally familiar with door systems will be able to apply the novel characteristics of the structures illustrated and described herein in other contexts by modification of certain details. Accordingly, the drawings and description are not to be taken as restrictive on the scope of this invention, but are to be understood as broad and general teachings.

Further, the entirety of U.S. Pat. Nos. 5,158,043, 4,574,973, and 4,685,586 are incorporated herein by reference thereto.

Referring now to the drawings in detail, wherein like reference characters represent like elements or features throughout the various views, the door system of the present invention is indicated generally in the figures by reference character 10.

Turning to FIG. 1, door system 10 is shown installed in a typical application within the wall, generally W, of a structure, generally S. Door system 10 includes an outer door, generally OD, within an exterior door frame, generally 14. Outer door OD is held in place by rotatable retainers, generally 18, which are pivotally connected to exterior door frame 14. Handles 20 are attached to outer door OD to facilitate removal of outer door OD upon pivoting of retainers 18 to a position whereby outer door OD can be removed.

Figure 2:
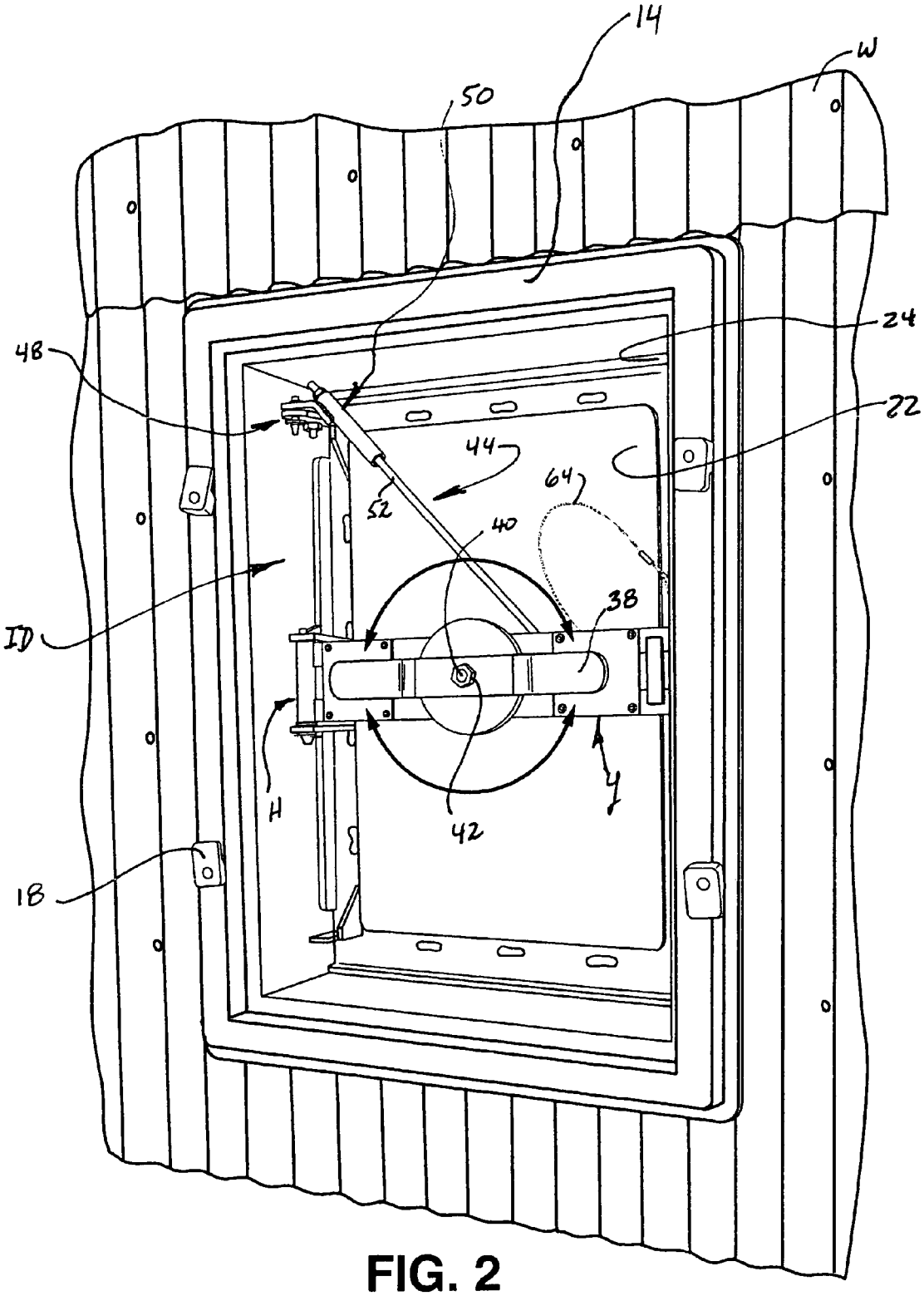
FIG. 2 is a perspective view of the door system illustrated in FIG. 1, with the outer door removed, and the inner door exposed.

FIG. 2 illustrates the inner door assembly, generally ID, of door system 10, outer door OD having been removed. Note retainers 18 have been pivoted to a position which allows for removal of outer door OD from exterior door frame 14, or installation of outer door OD within door frame 14.

Inner door assembly ID includes a compressible inner door 22 to which a bridge, cross-member structure, or, as referred to herein, a "yoke," generally Y, is connected. Although the drawings of the present invention illustrate only one yoke Y being used in connection with inner door assembly OD, it is to be understood that multiple yokes could be used on inner door assembly ID, depending on the size and configuration of an inner door 22 used in a particular application, or as otherwise desired.

Yoke Y includes a hinge, generally H, which pivotally attaches yoke Y to inner door frame, generally 24. The other end of yoke Y includes a latch pin locking arrangement, generally 28, (FIG. 5) which includes an upper receiver 30 and a lower receiver 32 with an opening for receiving a latch pin 34. A receiver 36 is fixed to inner door frame 24, and is also configured for receipt of pin 34, such that upon receivers 30, 32 being generally in line with receiver 36, pin 34 may be inserted therein to securely lock inner door 22 in place within inner door frame 24.

FIG. 2 further illustrates a rotatable handle, generally 38, attached for rotation with respect to yoke Y, as discussed in more detail later, handle 38 is fixed to a turning screw, generally 40, having a jam nut 42 fixed thereto.

A sag rod assembly, generally 44, is connected between yoke Y and an upper hinge arrangement, generally 48, which allows the upper end 50 of a sag rod 42 to pivot with respect to inner door frame 24, as inner door 22 is moved between the open and closed positions.

Figure 3:
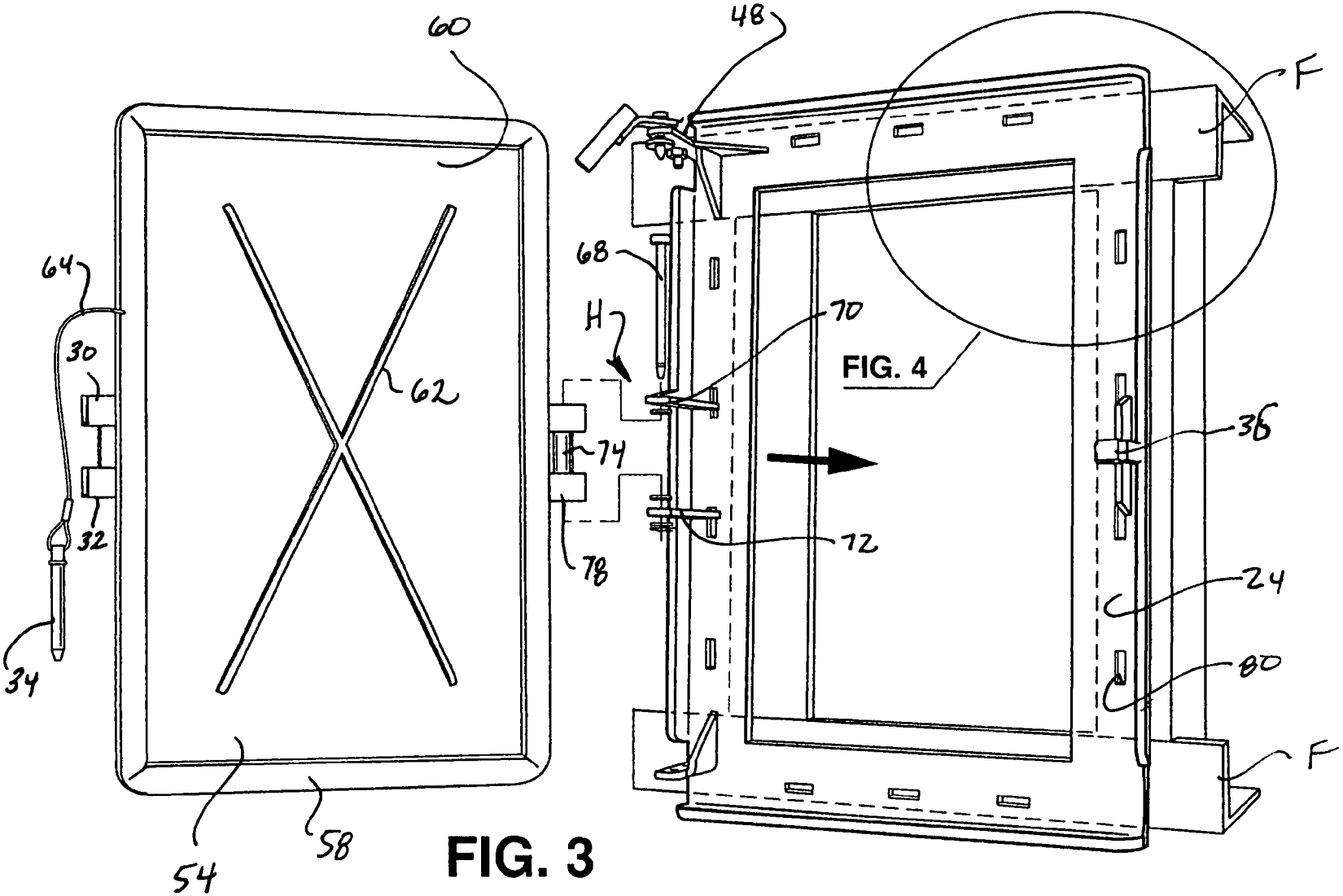
FIG. 3 is a perspective view a door system constructed in accordance with the present invention with the inner door open.

FIG. 3 illustrates the backside 54 of inner door 22. A gasket 58 is provided about the periphery of inner door 22. Gasket 58 is preferably constructed of material able to withstand high or extremely high temperatures, such as would be experienced in boilers, flues, scrubbers, precipitators, bag houses, and the like. Also provided on the inner surface 60 of inner door 22 is bracing, generally 62, preferably in the form of an X, and preferably constructed of steel and being attached, such as by welding, to inner surface 60. The X-shaped bracing helps to more evenly distribute forces applied to inner door 22, particularly with respect to turning screw 40. FIG. 3 also illustrates a cable 64 attached to pin 34 in order to retain pin 34 on inner door 22 during use and during those times when pin 34 is removed from receivers 30, 32, and 36. The other end of yoke Y, which is attached to hinge H, includes hinge H having a hinge pin, generally 68, which passes through upper and lower receivers 70, 72, and also through a suitable receiver 74 within end 78 of yoke Y.

Figure 4:
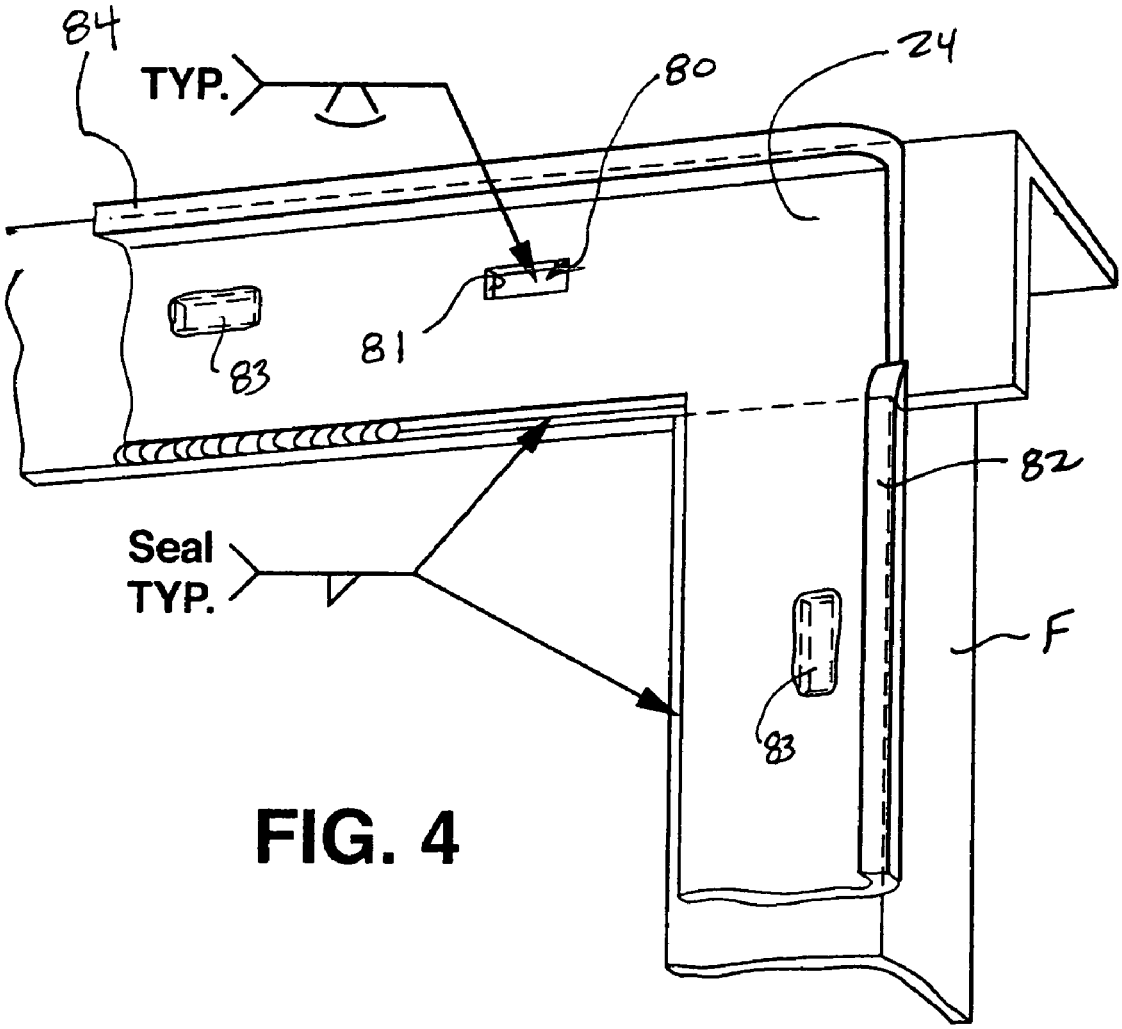
FIG. 4 is an enlarged partial perspective view taken from the FIG. 4 inset of FIG. 3.

FIG. 3 shows, and FIG. 4 also shows in more detailed, inner door frame 24 having slots, generally 80, provided about the periphery of inner door frame 24. Inner door frame 24 is generally attached to frame members, generally F, of structure S by welding. In attaching such inner door frame to structure S, the interior periphery of inner door frame F is welded to the structure S as shown in FIG. 4, and the slots 80, having weld surfaces 81, provided in generally planar portions of frame 24 are also welded via welds 83 to structure S in order to maintain dimensional stability of inner door frame 24, and in particular, to prevent warping or bending of inner door frame 24 upon welding of the inner periphery thereof to structure S. Note inner door frame 24 includes vertical flange portions 82, and horizontal edge flange portions 84.

Figure 5:
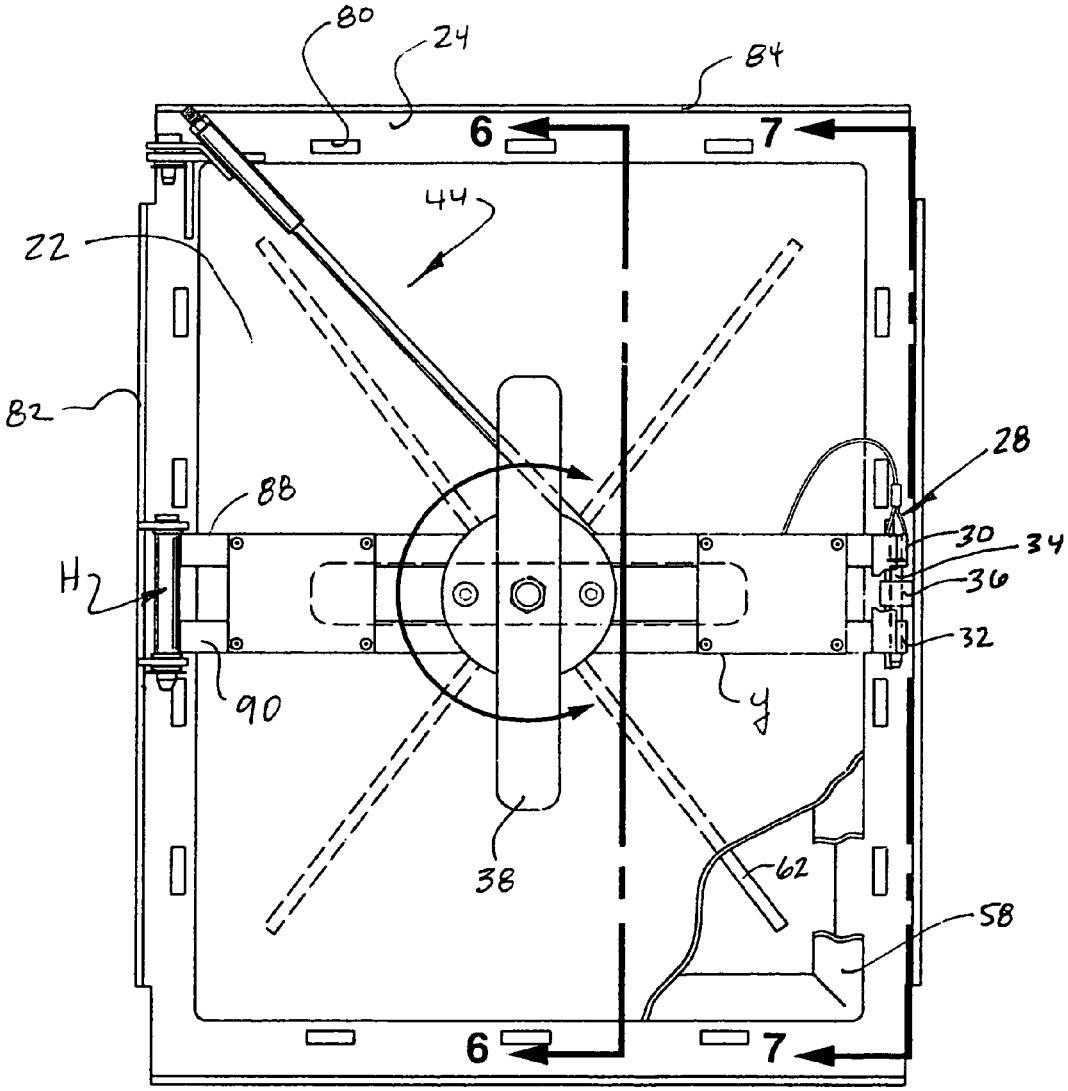
FIG. 5 is a front elevational view, with parts cut away, of a door system constructed in accordance with the present invention.
Figure 6A:
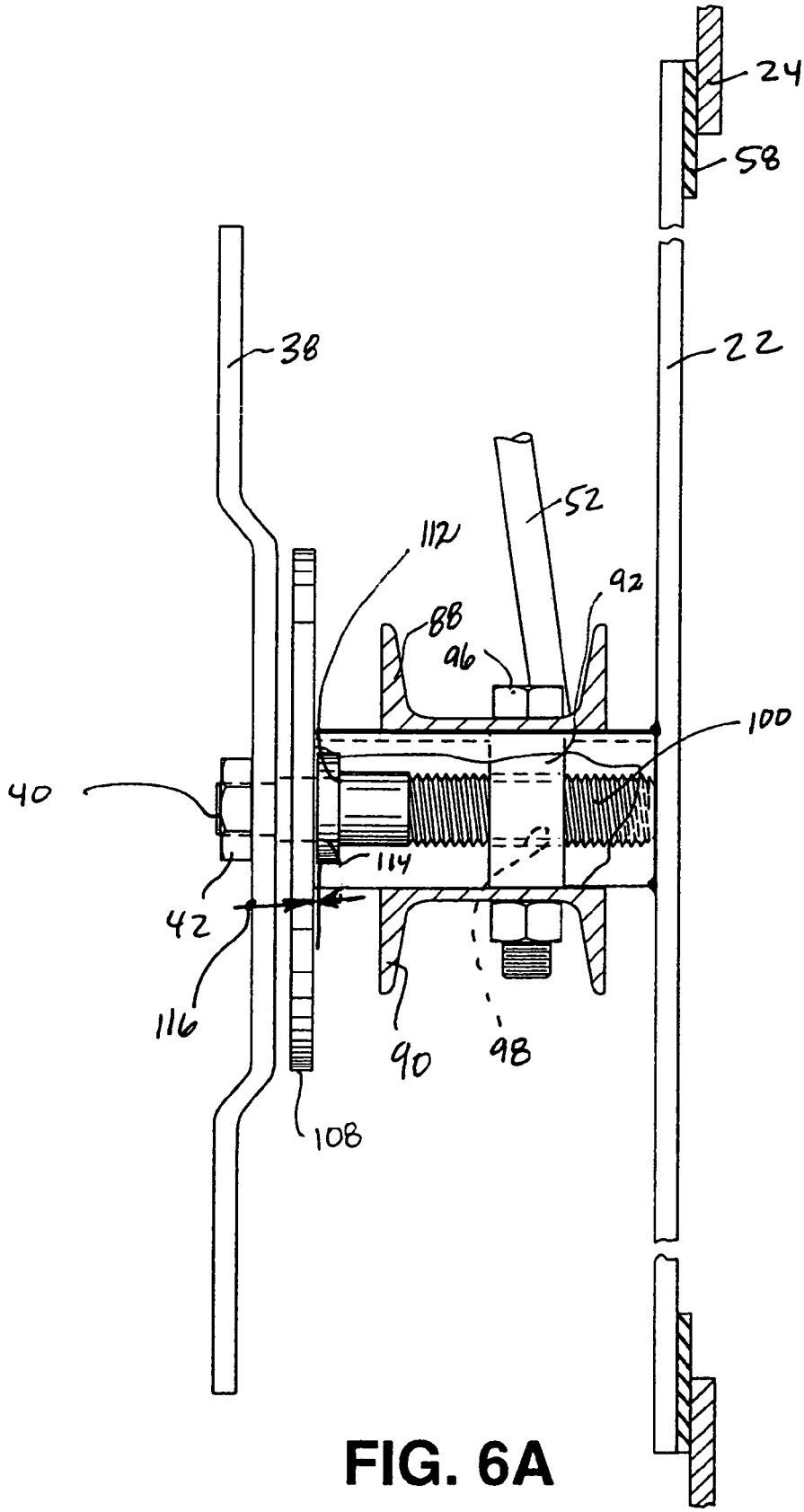
FIG. 6A is a sectional view taken along line 6-6 of FIG. 5, illustrating an inner door of a door system constructed in accordance with the present invention, showing the inner door sealed.
Figure 6B:
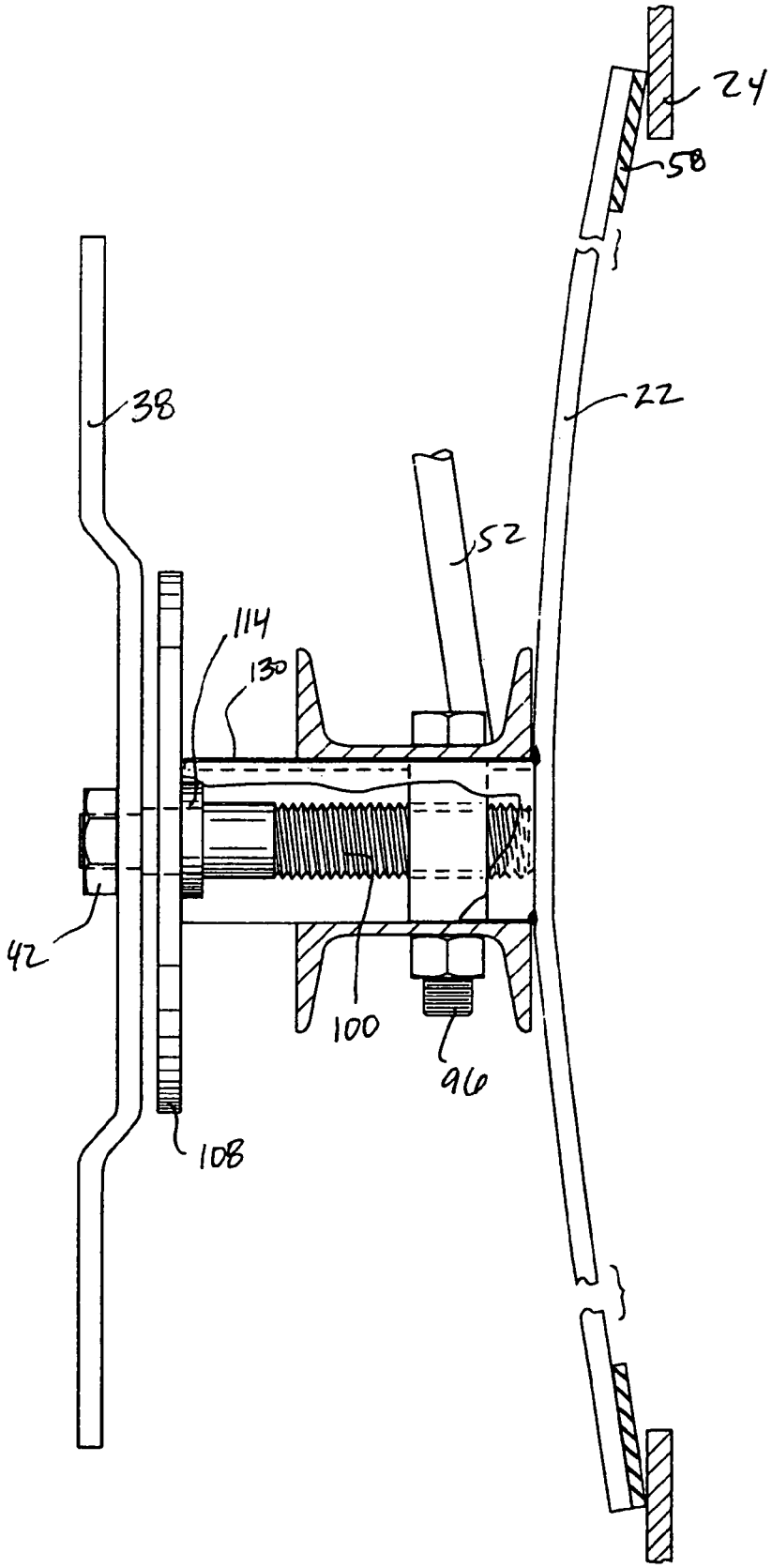
FIG. 6B is a sectional view taken along lines 6-6 of FIG. 5, illustrating an inner door of a door system constructed in accordance with the present invention with the inner door in an intermediate configuration between being opened and sealed.

FIG. 5 illustrates inner door assembly ID in a position within inner door frame 24 characterized in that pin 34 is received in upper and lower receivers 30, 32, and fixed receiver 36. As shown in FIG. 6A, which is a sectional view taken along lines 6-6 in FIG. 5, inner door 22 is shown in a closed, sealing position, with gasket 58 tightly sealing, in a gas-tight relationship, inner door 22 against inner door frame 24. As also shown in FIG. 6A, yoke assembly Y includes turning screw 40 being forwardly advanced in order to sufficiently compress and flatten inner door 22 from its normally concave, or dome-shaped configuration, as shown in FIGS. 6B, 7B, and 7C.

Yoke assembly Y includes upper and lower cross-members 88, 90 and a nut plate 92 fixedly attached therebetween by two bolts 94, 96. Nut plate 92 includes a threaded bore 98 for threading engagement with threaded portion 100 of turning screw 40.

Figure 8:
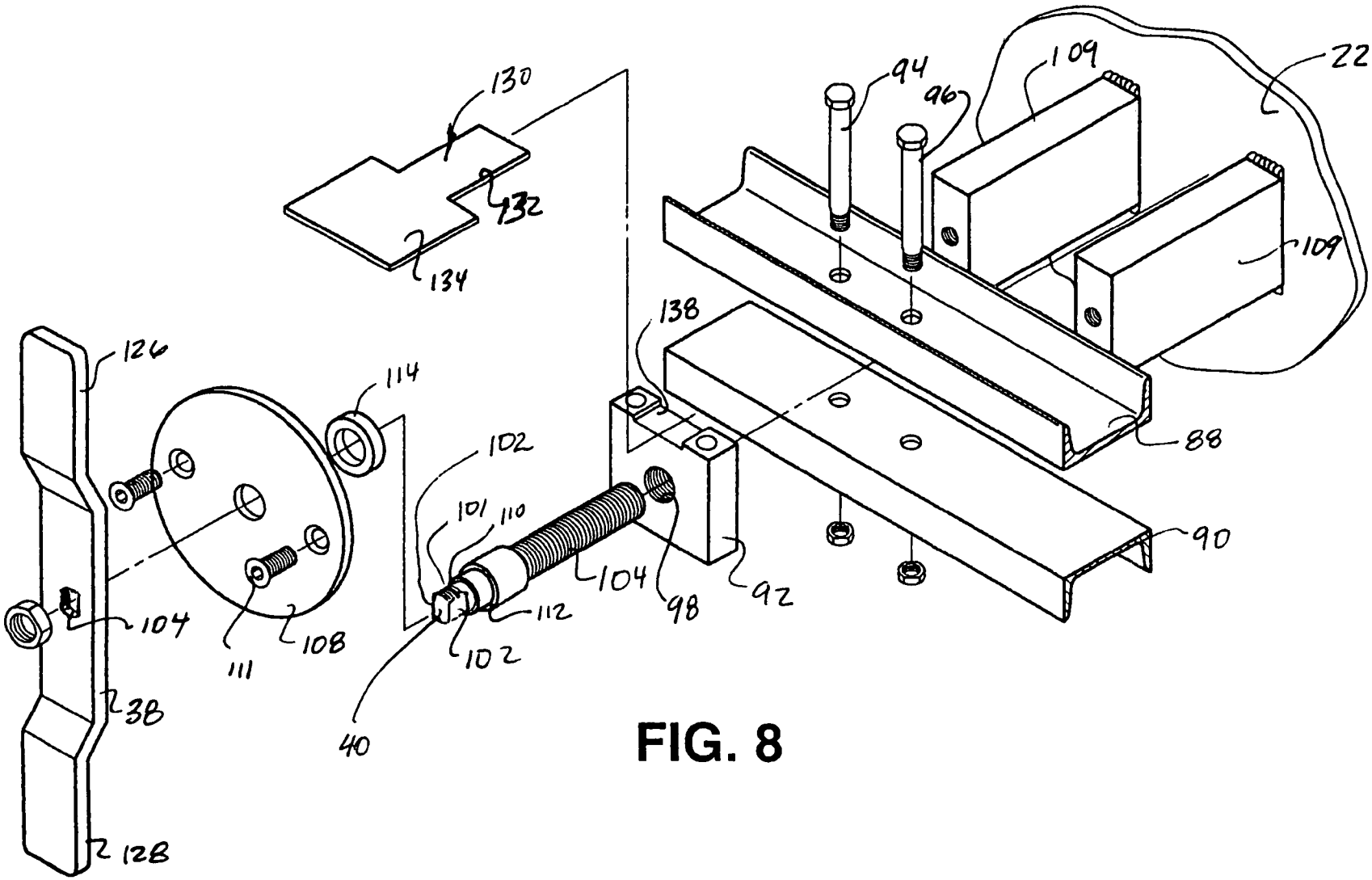
FIG. 8 is an exploded view of a yoke assembly of an inner door of a door system constructed in accordance with the present invention.

As shown in FIG. 8, turning screw 40 has a threaded end portion 101, with flats 102 for receipt in a cooperating slot 104 in handle 38. The cooperation of flats 102 of turning screw 40 with slot 104 of handle 38 prevents relative rotation of handle 38 with respect to turning screw 40. Jam nut 42 is used to fixedly attach handle 38 to turning screw 40.

FIG. 6A illustrates a generally circular plate, or bearing member, 108 which is attached to arms 109 extending outwardly from inner door panel 22 (FIG. 8) using bolts 111.

Turning screw 40 includes a first shoulder 110 (FIG. 8), which engages the backside of handle 38, and also a second shoulder 112 which provides a bearing surface against which a thrust collar 114 bears during operation of door system 10. Thrust collar 114 is carried between shoulder 112 of turning screw 40 and the backside of plate 108, and acts as a thrust bearing during inward advancement of turning screw 40 during sealing of inner door 22, and also bears against the backside of plate 108 during reverse rotation of turning screw 40 when inner door 22 is to be opened. However, there is a slight amount of clearance, or, gap 116, preferably on the order of twenty-four to twenty-five thousandths of an inch (0.024"-0.025") to provide, as discussed above, the "window of opportunity," when inner door 22 is to be opened. It is to be understood, however, that the present invention contemplates windows of opportunity involving clearances other than that specifically set forth herein. This clearance allows for a certain amount of rotation of handle 38 to relieve pressure applied by turning screw 40 to inner door 22, by an amount such that, as shown in FIG. 6B, inner door 22 begins to decompress and move slightly towards its normally concave profile, while, at the same time, maintaining the four corners of inner door panel 22 in contact with inner door frame 24. However, continued rotation of handle H in a direction for withdrawing turning screw 40 eventually causes the four corners of inner door 22 to no longer contact inner door frame 24, as shown in FIG. 7C.

Figure 7A:
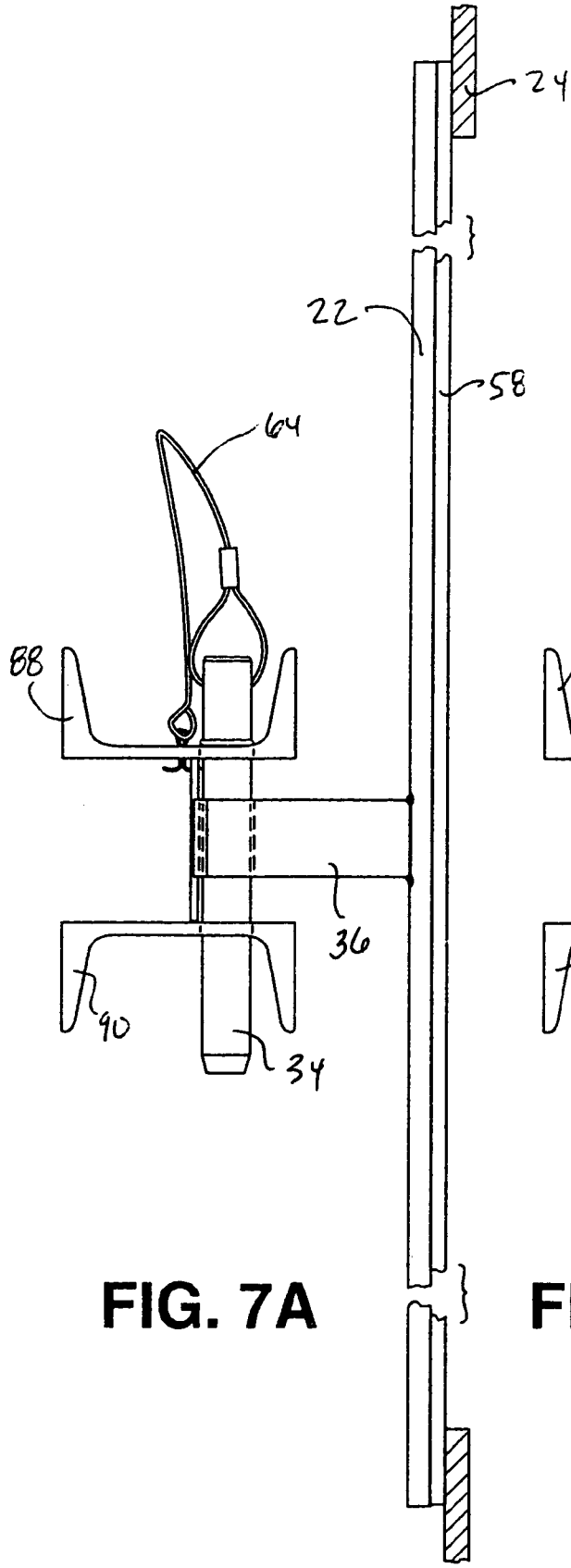
FIG. 7A is a sectional view taken along lines 7-7 of FIG. 5, illustrating an inner door of a door system constructed in accordance with the present invention in a sealed configuration.
Figure 7B:
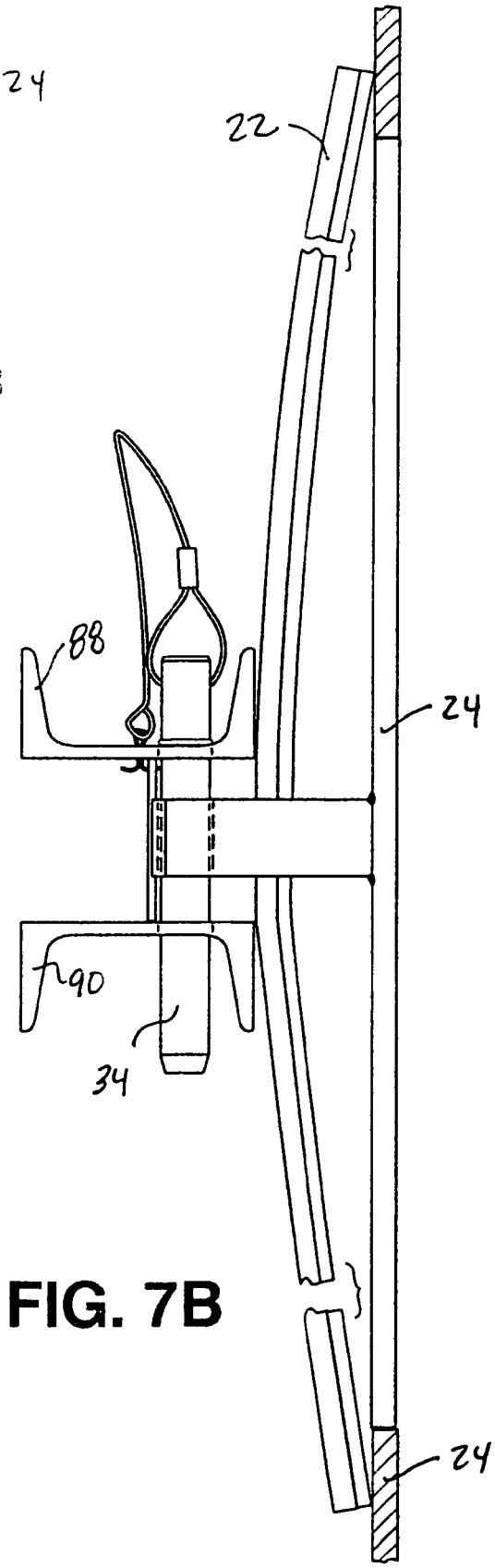
FIG. 7B is a sectional view taken along lines 7-7 of FIG. 5, illustrating an inner door of a door system constructed in accordance with the present invention in a intermediate position between being sealed and open.
Figure 7C:
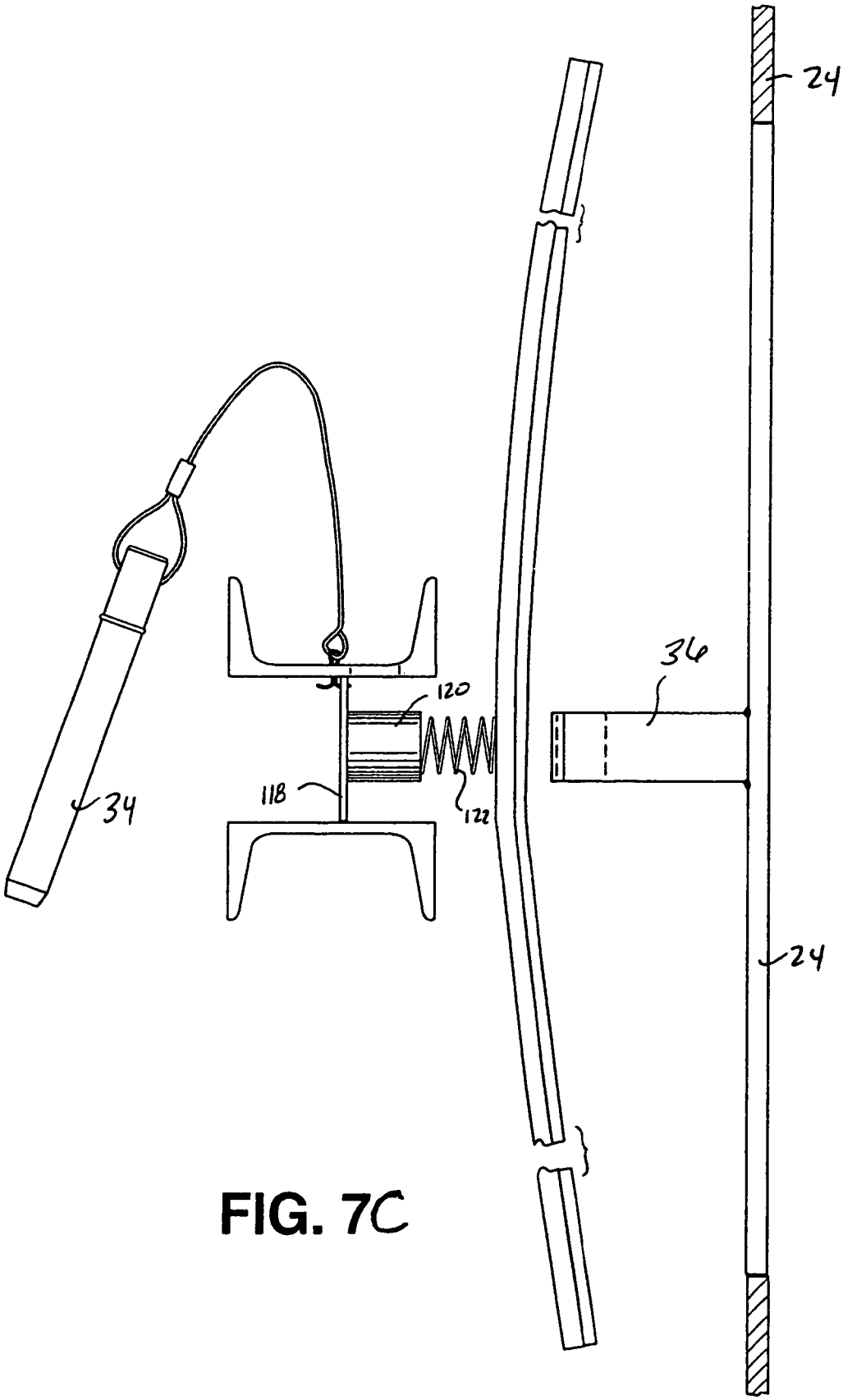
FIG. 7C is a sectional view taken along lines 7-7 of FIG. 5, illustrating an inner door of a door system constructed in accordance with the present invention in an open position.

FIG. 7A shows inner door 22 in a closed, sealing position with respect to inner door frame 24. In this configuration, pin 34 is received within upper and lower receivers 30, 32, and fixed receiver 36. Pin 34 is securely held in this configuration, and is not subject to being removed.

In FIG. 7B, inner door 22 has been slightly opened, perhaps through use of the window of opportunity, and the upper and lower edges of inner door 22 are still in contact with inner door frame 24. In this configuration, pin 34 is still held in place within receivers 30, 32, and 36.

In FIG. 7C, however, inner door panel 22 has been pulled away from inner door frame 24 in a sufficient manner, through withdrawal of turning screw 40, such that pin 34 can be removed from receivers 30, 32, and 36.

FIG. 7C also illustrates a generally vertically extending plate 118 to which a boss 120 is attached. Attached to boss 120 is a preload spring 122 which acts between yoke Y and inner door 22 for exerting a biasing force between inner door 22 and yoke Y. This thereby places a frictional load on pin 34, preventing inadvertent the removal of pin 34, which assists in preventing opening of inner door 22. Also, this helps prevent damage to gasket 58 due to inadvertent interference between gasket 58 and inner door frame 24.

Turning to FIG. 8, it is noted that handle 38 includes offset portions 126, 129, which provide relief for a user's hands by allowing the user's hands to be spaced further away from upper and lower cross-members 88, 90, thereby improving the usability and potential comfort of handle 38.

FIG. 8 also illustrates a debris, or, dust, guard 130 constructed in accordance with the present invention. Dust guard 130 is of a generally T-shaped profile and serves to cover the threaded portion 101 of turning screw 40 during generally the full range of motion of turning screw 40, as turning screw 40 advances to seal or retracts to unseal inner door 22. Dust guard 130 includes a stem portion 132 and a transverse portion 134 connected thereto. Stem portion 132 is slidingly received within a recess 138 defined in the upper surface of nut block 92. Stem portion 132 slides within recess 138, and in a passage between bolts 94 and 96 as turning screw 40 is moved inwardly and outwardly, and shields threaded portion 101 from fly ash and other debris. By preventing accumulation of such debris on threaded portion 101, the service life of turning screw 40 is improved in that galling and binding of turning screw 40 within the threads of nut block 92 is reduced.

From the foregoing, it can be seen that the door system of the present invention provides numerous improvements and advancements over door systems found in the prior art.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A door system for use in a high temperature structure having a metal wall portion, the metal wall portion defining a doorway into the high temperature structure, the door system comprising:

a metal door frame configured to extend generally about the periphery of the doorway and generally parallel to the metal wall portion of the high temperature structure;

said metal door frame defining a plurality of slots therein, said slots each defining weld surfaces configured for allowing said metal door frame to be welded to the doorway;

a compressible door for selectively blocking the doorway;

a screw configured for causing selective compression of the door upon rotation of said screw in a first direction and selective decompression upon rotation of said screw in a second direction generally opposite to said first direction;

said screw having a projection;

a bridge spanning substantially across the door;

a bearing member attached to said bridge for receiving said screw;

at least one arm extending outwardly from the door;

at least one cross-member connected to said arm;

a guide member for receiving said screw, said guide member being fixed relative to rotation of said screw;

connectors readily releasably connecting said guide member to said cross-member;

a handle connected to said screw for turning said screw;

a fastener for readily releasably connecting said handle to said screw;

a debris guard having an elongated portion substantially covering the length of the screw;

said debris guard being configured to move with and cover the screw as the screw is rotated;

a collar carried on said screw between said projection and said bearing member and configured to bear against said bearing member and said projection upon rotation of said screw in said first direction to compress the door; and said collar being configured to provide a gap of predetermined width between said projection and said bearing member upon rotation of said screw in said second direction to decompress the door.

2. A device for use in a door system of a high temperature structure having a wall portion, the wall portion defining a doorway into the high temperature structure, the device comprising:

a compressible door;

a screw configured for causing selective compression of the door upon rotation of said screw in a first direction and selective decompression upon rotation in a second direction generally opposite to said first direction;

a bridge spanning substantially across the door;

a bearing member attached to said bridge for receiving said screw;

at least one arm extending outwardly from the door;

at least one cross-member connected to said arm;

a guide member for receiving said screw, said guide member being fixed relative to rotation of said screw;

said screw having a radially extending shoulder;

a collar carried on said screw between said shoulder and said bearing member and configured to bear against said bearing member and said shoulder upon rotation of said screw in said first direction to compress the door; and said collar being configured to provide a gap of predetermined width between said shoulder and said bearing member upon rotation of said screw in said second direction to decompress the door.

3. The device as defined in claim 2, further comprising bolts that connect said guide member to said cross-member.

4. The device as defined in claim 2, wherein said guide member has a threaded bore for receiving said screw.

5. A door system for use in a high temperature structure having a metal wall portion, the metal wall portion defining a doorway into the high temperature structure, the door system comprising:

a metal door frame configured to extend generally about the periphery of the doorway and generally parallel to the metal wall portion of the high temperature structure;

said metal door frame defining a plurality of slots therein, said slots each defining weld surfaces configured for allowing said metal door frame to be welded to the doorway;

a compressible door for selectively blocking the doorway;

a screw configured for causing selective compression of the door upon rotation of said screw in a first direction and selective decompression upon rotation of said screw in a second direction generally opposite to said first direction;

said screw having a first end and a second end generally opposite said first end, said first end including two generally diametrically opposed flat portions and first threaded portions extending between said two flat portions;

said screw having a circumferentially extending shoulder between said first end and said second end; said screw having second threaded portions between said shoulder and said second end of said screw;

a bridge spanning substantially across the door;

a bearing member attached to said bridge for receiving said screw;

at least one arm extending outwardly from the door;

at least one cross-member connected to said arm;

a guide member defining a threaded bore for threadingly receiving said second threaded portions of said screw, said guide member being fixed relative to rotation of said screw;

at least two bolts readily releasably connecting said guide member to said cross-member;

a handle connected to said screw for turning said screw; said handle being elongated and including a first end and a second end generally opposite said first end and an intermediate portion therebetween;

said first end of said handle and said second end of said handle being laterally offset from said intermediate portion;

said handle including a slot having two generally diametrically opposed surface portions for cooperating with said two flat portions of said screw;

a jam nut for readily releasably connecting said handle to said screw; said jam nut threadingly engaging said first threaded portions of said screw;

a debris guard having an elongated portion substantially covering the length of the screw;

said debris guard being configured to move with and cover the screw as the screw is rotated;

said two bolts connecting said guide member to said cross-member being configured to define a passage for sliding receipt of said elongated portion of said debris guard as said debris guard moves with and covers the screw upon the screw being rotated;

a collar carried on said screw between said shoulder and said bearing member and configured to bear against said bearing member and said shoulder upon rotation of said screw in said first direction to compress the door; and said collar being configured to provide a cap of approximately 0.024-0.025 inches between said collar and said bearing member upon rotation of said screw in said second direction to decompress the door.

6. A door system for use in a high temperature structure having a metal wall portion, the metal wall portion defining a doorway into the high temperature structure, the door system comprising:

a compressible door for selectively blocking the doorway;

a screw configured for causing selective compression of the door upon rotation of said screw in a first direction and selective decompression upon rotation of said screw in a second direction generally opposite to said first direction;

a bridge spanning substantially across the door;

a bearing member attached to said bridge for receiving said screw;

at least one arm extending outwardly from the door;

at least one cross-member connected to said arm;

a guide member for receiving said screw, said guide member being fixed relative to rotation of said screw;

said guide member being connected to said cross-member;

a handle connected to said screw for turning said screw;

a debris guard having a portion substantially covering the length of the screw;

said debris guard being configured to move with and substantially cover the screw as the screw is rotated;

a collar carried on said screw and configured to bear against said bearing member upon rotation of said screw in said first direction to compress the door; and said collar being configured to provide a gap of predetermined width between said screw and said bearing member upon rotation of said screw in said second direction to decompress the door.

* * * * *